United States Patent [19]

Skarman

[11] Patent Number: 4,529,151

[45] Date of Patent: Jul. 16, 1985

[54] METHOD AND AN APPARATUS FOR STEERING AN AERODYNAMIC BODY HAVING A HOMING DEVICE

[75] Inventor: Bengt Skarman, Linköping, Sweden

[73] Assignee: Saab-Scania Aktiebolag, Linköping, Sweden

[21] Appl. No.: 509,439

[22] PCT Filed: Oct. 6, 1982

[86] PCT No.: PCT/SE82/00317

§ 371 Date: Jun. 2, 1983

§ 102(e) Date: Jun. 2, 1983

[87] PCT Pub. No.: WO83/01298

PCT Pub. Date: Apr. 14, 1983

[30] Foreign Application Priority Data

Oct. 8, 1981 [SE] Sweden ..... 8105948

[51] Int. Cl.[3] ..... F41G 7/22

[52] U.S. Cl. ..... 244/3.15

[58] Field of Search ..... 244/3.15, 3.16, 3.19, 244/3.2, 3.21, 3.22

[56] References Cited

U.S. PATENT DOCUMENTS

| | | | |
|---|---|---|---|
| 3,181,813 | 5/1965 | Gulick, Jr. et al. | 244/3.19 |
| 3,189,300 | 6/1965 | Robert | 244/3.19 |
| 3,206,143 | 9/1965 | Munchhofen | 244/3.15 |
| 3,372,890 | 3/1968 | Bogard et al. | 244/3.17 |
| 3,523,659 | 8/1970 | Epperson, Jr. | 244/3.19 |
| 3,905,563 | 9/1975 | Nagoshi | 244/3.15 |
| 4,168,813 | 9/1979 | Pinson et al. | 244/3.15 |
| 4,288,050 | 9/1981 | Gauggel | 244/3.16 |
| 4,456,862 | 6/1984 | Yueh | 244/3.16 |

FOREIGN PATENT DOCUMENTS

| | | |
|---|---|---|
| 1009370 | 4/1977 | Canada . |
| 1075360 | 4/1980 | Canada . |
| 33283 | 8/1981 | European Pat. Off. . |
| 2738507 | 3/1979 | Fed. Rep. of Germany . |

*Primary Examiner*—Charles T. Jordan

*Attorney, Agent, or Firm*—James E. Nilles; James R. Custin

[57] ABSTRACT

An aerodynamic body (M) provided with means for steering in response to a body control variable signal has a homing device (1) supplying a measurement signal ($\epsilon_m$) of the error angle of the body. For intercepting a target (T) a computing unit (10), operating on the basis of relationships describing the aerodynamic behavior of the body with respect to the target, determines signal values ($\sigma$, $\theta$) representing approximations of the line of sight angular rate ($\sigma$) and the attitude angular rate ($\theta$). The input signal to the computing unit (10) is the body control variable signal (u, $u_m$) which is dependent on the determined approximation ($\sigma$) of the line of sight angular rate. From said two signal values ($\sigma$, $\theta$) a signal value ($\epsilon$) representing an approximation of the error angle is determined. An error angle difference signal value ($\Delta\epsilon=\epsilon_m-\epsilon$) is determined and fed back to the computing unit (10) for correcting quantities of the relationships thereof.

8 Claims, 3 Drawing Figures

METHOD AND AN APPARATUS FOR STEERING AN AERODYNAMIC BODY HAVING A HOMING DEVICE

TECHNICAL FIELD

The present invention relates to a method and an apparatus for steering an aerodynamic body, e.g. a missile or projectile, after its firing toward a target. By means of the output signal of a homing device, which signal is a measurement of the instantaneous value of an error angle between a body-fixed axis, preferably the symmetry axis of the body and the line of sight from the body to the target, the body is guided in a flight path toward the target, and in response to a control variable signal which is dependent on the angular rate of the line of sight.

BACKGROUND ART

In prior art missiles having a homing device for determining the error angle $\epsilon$ between the missile attitude and the line of sight to the target a gyro is employed for determining the attitude angular rate $\dot{\theta}$ which is required for calculating the angular rate $\dot{\sigma}$ of the line of sight according to a relation $$\dot{\sigma}=\dot{\epsilon}+\dot{\theta}$$

For reducing costs it is desirable to eliminate the expensive gyro.

DISCLOSURE OF THE INVENTION

The object of the invention is to provide a method and an apparatus of the kind mentioned by way of introduction for steering a missile without requiring any gyro.

According to the invention this object is achieved by determining on the basis of relationships describing the aerodynamic behaviour of the body with respect to the target, a signal value representing the line of sight angular rate, on the one hand, and a signal value representing the body attitude angular rate, on the other hand. Said two signal values are combined to form a signal value of the error angle. A difference error angle signal value is formed by an error angle measurement received from the homing device and the approximate error angle signal value and is fed back to said aerodynamic relationships in order to update quantities of said relationships.

An apparatus for performing said method is also described.

BRIEF DESCRIPTION OF THE DRAWINGS

The invention is described below in greater detail and with reference to the accompanying drawings.

MODE FOR CARRYING OUT THE INVENTION AND INDUSTRIAL APPLICABILITY

Figure 1:
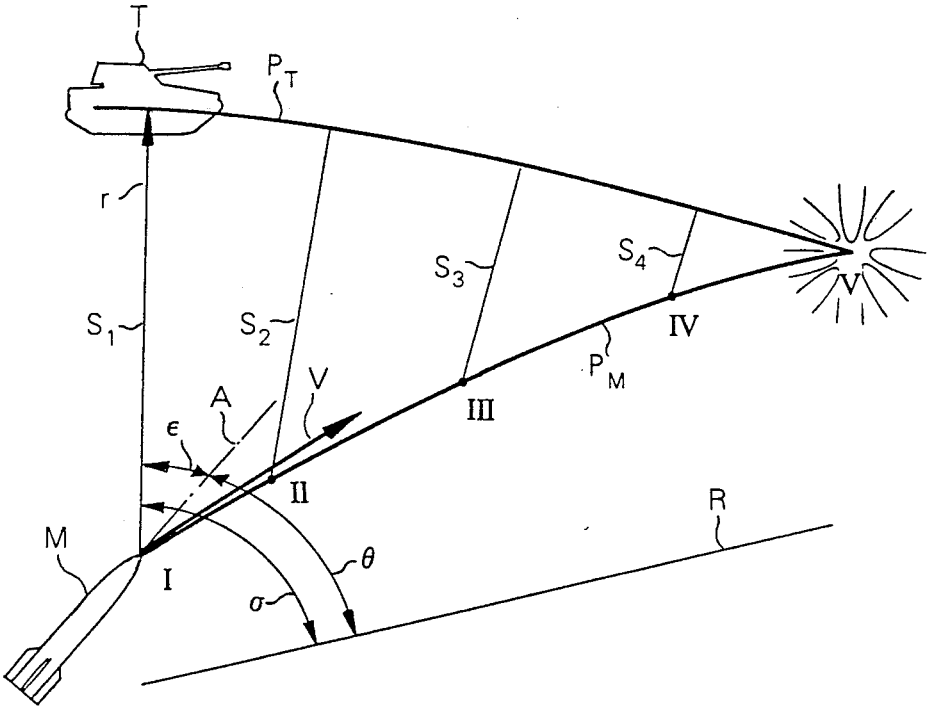
FIG. 1 is a single plane representation of a missile in outline which by proportional navigation is steered toward a moving target for interception thereof, some essential quantities being shown.

The invention is applicable in all types of missiles, e.g. a guided missile or artillery projectile, provided with means to bring about guided deflection. FIG. 1 shows such a missile M moving in a flight path $P_M$ towards a target vehicle T which is moving in a path $P_T$. It is shown by means of lines of sight $S_1$–$S_4$ in four positions I, II, III and IV how the missile is closing in on the target at the same time as the lines of sight become gradually more parallel as the missile comes closer to the target.

In the position I the missile M has a speed V in the flight direction. $\sigma$ is the line of sight angle between the line of sight S and an inertial reference direction R. $\theta$ designates the attitude angle of the missile between a body-fixed axis A, here the axis of symmetry of the missile, and the inertial reference direction R. $\epsilon$ is an error angle between the body-fixed axis A and the line of sight S. It is seen that the error angle $\epsilon$ is obtained from the line of sight angle $\sigma$ and the attitude angle $\theta$ according to the relationship $$\epsilon=\sigma-\theta.$$

Figure 2:
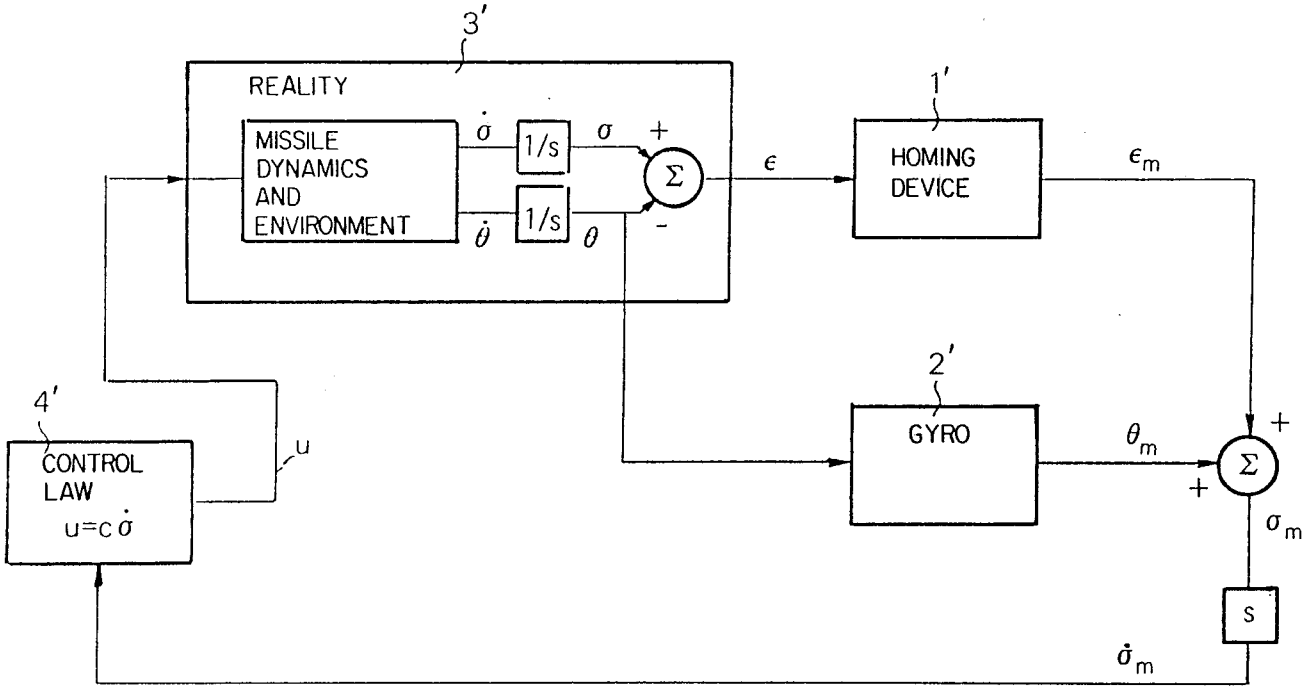
Fig. 2 PRIOR ART
FIG. 2 is a one channel schematic block diagram of a prior art system for proportional missile navigation and showing the operation thereof.

FIG. 2 is an operational block diagram of one example of a prior art missile system of the proportional navigation type using a homing device 1'. Any influence on the missile with respect to the missile dynamics, the environment and guided deflection is illustrated by means of a block 3'. Actual values of the line of sight angle $\sigma$ and the attitude angle $\theta$ received from the block 3' result in an actual error angle $\epsilon$. This latter angle is measured by the homing device 1', the output signal of which is a measurement $\epsilon_m$ of the instantaneous error angle between the body-fixed axis of symmetry A and the line of sight S.

As mentioned by way of introduction such a system requires a gyro 2' which is here employed for determining a measurement $\theta_m$ of the attitude angle of the missile. The measurements $\theta_m$ and $\epsilon_m$ are added for obtaining a quantity $\sigma_m$ of the line of sight angle which after differentiation results in a quantity $\dot{\sigma}_m$ of the angular rate of the line of sight. By means of this latter quantity a signal representing a control variable u is computed in a block 4' on the basis of the control law $u=c\cdot\dot{\sigma}$ according to the principle of proportional navigation where c is a constant. The signal representing the control variable u is fed to a not shown steering apparatus of the missile in the block 3', and the control variable can be realized by means of a control surface deflection.

In the description of the prior art above and the invention below the missile projectile, for the sake of simplicity, is assumed to move in one and the same vertical or horizontal plane corresponding to the pitch or yaw channel, respectively. However, both the prior art method and the invention have a more general application and in practice the missile is also steerable in a second plane perpendicular to said first plane. The relationships of the aerodynamic behaviour of the missile utilized below in the disclosed embodiment of the invention are meant to describe movement in a vertical plane, and yet it has been possible to neglect the influence of gravity. It is therefore evident that the relationships describing the missile movement perpendicular to the vertical plane are not more involved.

Figure 3:
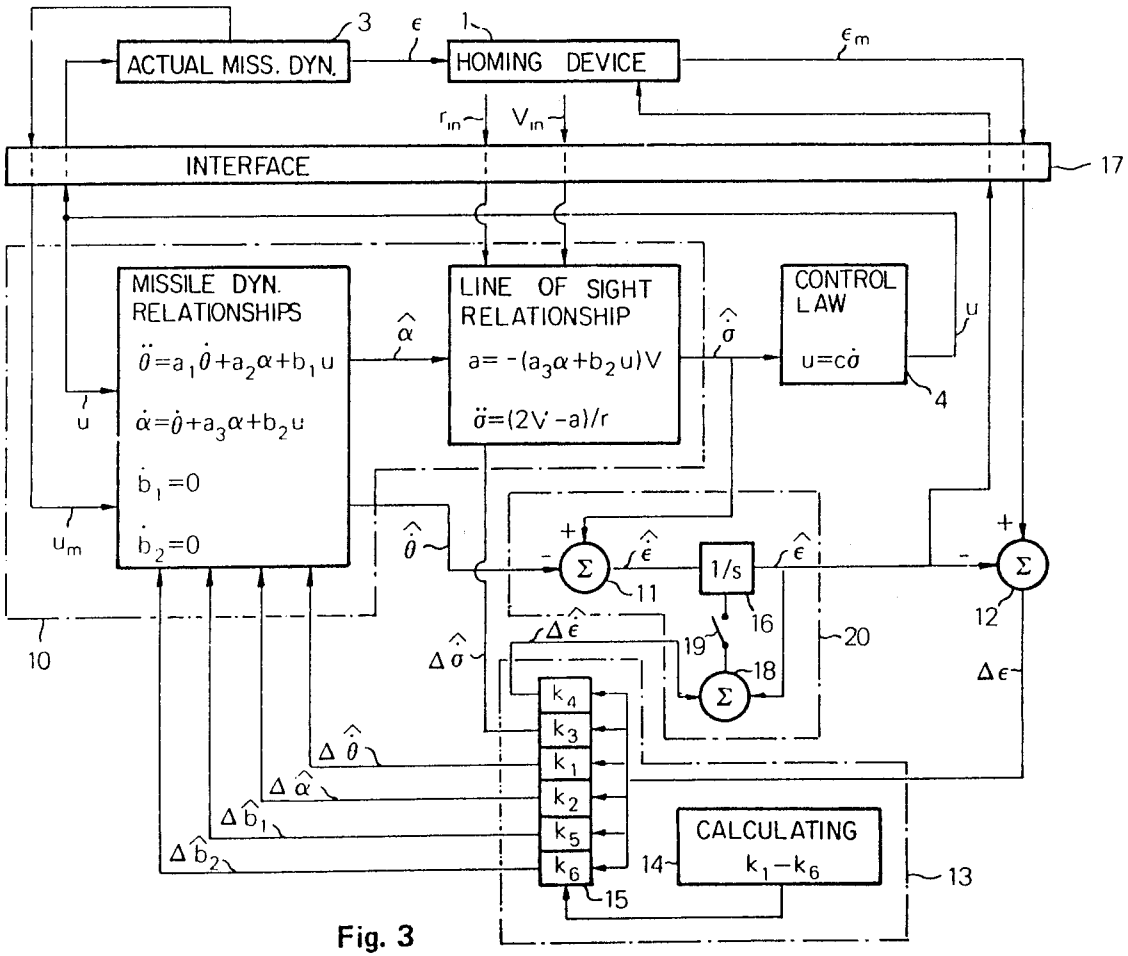
FIG. 3 is a one channel schematic block diagram of the invention showing the operation thereof and having a lay-out similar to FIG. 2.

FIG. 3 illustrates the invention with reference to an embodiment having proportional navigation. The block diagram in FIG. 3 includes blocks 1, 3 and 4 having the same respectively operation as the corresponding blocks in FIG. 2 provided with prime symbols.

In order to obviate the need of an expensive gyro, a computing unit 10 is employed according to the invention, said computing unit operating on the basis of relationships describing the missile aerodynamic behaviour with respect to the target for determining a signal value which is a prediction or approximate value $\hat{\dot{\sigma}}$ of the angular rate of the line of sight. Said relationships form a more or less approximate mathematical model of the aerodynamic behaviour of the missile with respect to the target. In the here described preferred embodiment these relationships, as can be seen below, are previously known which, however, does not exclude the fact that other similar relationships can be employed within the frame of the invention.

In a first step the computing unit 10 establishes, by means of relationships for the missile aerodynamics, a signal value $\hat{\dot{\theta}}$ representing an approximation of the angular rate $\dot{\theta}$ of the attitude of the missile. Moreover, by means of said missile aerodynamics relationships the computing unit 10 calculates an approximate value $\alpha$ for the aerodynamic angle of attack of the missile, which latter value is employed in a second step of the computing unit.

In the second step the computing unit 10, by means of relationships of the missile angular rate of the line of sight, establishes a signal value $\hat{\dot{\sigma}}$ representing an approximation of the angular rate of the line of sight. This signal value is employed as an input signal to the unit 4 for establishing the control variable signal u by means of a control law, here $u=c\cdot\dot{\sigma}$ according to the principles of proportional navigation.

The control variable signal u previously determined, alternatively the control surface deflection $u_m$ or the like provided as a measured signal from the steering apparatus in the block 3, serves as an input signal to the computing unit 10.

The two established signal values $\hat{\dot{\theta}}$ and $\hat{\dot{\sigma}}$ are combined as shown in a unit 20 for determining a signal $\hat{\dot{\epsilon}}$ which is an approximate value of the error angle. In a junction point 11 based on the relationship $\dot{\epsilon}=\dot{\sigma}-\dot{\theta}$ said two signal values result in a signal which is an approximate value $\hat{\dot{\epsilon}}$ of the error angle angular rate. Subsequent integration as shown in a block 16 labelled with the Laplace integration operator results in said signal $\hat{\epsilon}$.

The control variable u determined in the block 4 by the control law provides, in dependence upon the environmental conditions and the dynamics of the missile according to the block 3, an error angle $\epsilon$ which is measured to $\epsilon_m$ by the homing device 1 in a prior art manner. It should be mentioned that the homing device can be, and preferably is, fixed to the body of the missile. On the other hand the homing device also may be directable with respect to the missile axis, however without being gyrostabilized, since the lack of a gyro is an object of the invention.

The signal value $\hat{\epsilon}$ determined as the approximate value of the error angle is combined by subtraction in a junction point 12 with the signal value $\epsilon_m$ of the measurement of the error angle, resulting in a difference signal corresponding to the difference $$\Delta\epsilon=\epsilon_m-\hat{\epsilon}.$$

This error angle difference signal value $\Delta\epsilon$ is employed for correcting or updating quantities e.g. both state variables and desired parameters, in the relationships of the computing unit.

As a basis of the first step of the computing unit there are two state equations $$\ddot{\theta}=a_1\dot{\theta}+a_2\alpha+b_1u$$

$$\dot{\alpha}=\dot{\theta}+a_3\alpha+b_2u$$

where the state variables $\dot{\theta}$ and $\alpha$ correspond to the attitude angular rate and the aerodynamic angle of attack, respectively;

u is the control variable which can be realized as a control surface deflection;

$a_1$, $a_2$, $a_3$ are aerodynamic parameters which are dependent on the shape and mass distribution of the missile; $b_1$ and $b_2$ are a torque and a force parameter, respectively.

These state equations are approximations of more complete state equations which are found in e.g. Dynamic of Atmospheric Flight, pp 162, 163 by Bernard Etkin, John Wiley & Sons Inc., 1972.

It is realized that the solution of the two state equations results in the approximate values $\hat{\dot{\theta}}$ and $\hat{\alpha}$ of the attitude angular rate and the aerodynamic angle of attack, respectively.

As regards the parameters $b_1$ and $b_2$ in the state equations it is in this embodiment of the invention assumed that $\dot{b}_1=0$; $\dot{b}_2=0$, e.g. $b_1$ and $b_2$ are essentially constant.

During short intervals the approximate values $\hat{\dot{\theta}}$ and $\hat{\alpha}$ are determined by calculation and with the output control variable signal u from unit 4 or a measured control deflection signal $u_m$ as an input to the computing unit.

For determining in the second step of the computing unit 10 the approximate value $\hat{\dot{\sigma}}$ of the line of sight angular rate the following state equation is employed, viz., $$\ddot{\sigma}=(2\dot{\sigma}+a_3\alpha+b_2u)\cdot V/r$$

which is known per se. In this equation the quantities having the same symbols as above have the respective above stated signification. $\ddot{\sigma}$ and $\dot{\sigma}$ reresent the angular acceleration and the angular rate of the line of sight, respectively; V is the travelling speed of the missile which is assumed to be known and as an example may be constant; r is the distance from the missile to the target.

In the determination of the signal value $\hat{\dot{\sigma}}$ representing the approximation of the line of sight angular rate, first an approximate value $\hat{a}$ of the acceleration of the missile transverse to the line of sight is determined from the previously calculated approximation $\hat{\alpha}$ of the aerodynamic angle of attack. Said acceleration is approximated to the acceleration transverse to the axis of symmetry according to $a=-(a_3\alpha+b_2u)V$.

Then the signal of the approximate value $\hat{\dot{\sigma}}$ is determined according to $$\ddot{\sigma}=(2V\dot{\sigma}-a)/r$$

The control system of the missile is actuated at a predetermined distance to the target, detected by the homing device, an initial value $r_o$ for the distance to the target thereby being obtained. Then a distance value r is obtained in a manner not disclosed in the drawing. If the target is immobile the distance value r can as an example be expressed as $r=r_o-V\cdot t$, where t is the time after the initial distance value $r_o$ has been detected.

For determining the distance $r_o$ at which the control system of the missile is to start to operate, there is according to FIG. 3 a signal path $r_{in}$ to the computing unit 10. Over this signal path information is fed which establishes $r_o$ and may influence other quantities which can be dependent on $r_o$. Moreover, a signal path $V_{in}$ to the computing unit 10 is shown for determining the speed V in the embodiment here described.

In this connection it should be mentioned that the latter state equation for the signal of the approximate value $\hat{\dot{\sigma}}$ in applications with lower accuracy requirements on terminal miss distance can be replaced by the equation $\ddot{\sigma}=0$; in other words the line of sight angular rate is assumed to be constant in intervals between measurements of the error angle $\epsilon$.

The signal values $\hat{\dot{\sigma}}$ and $\hat{\dot{\theta}}$ determined by means of the computing unit 10, as mentioned above are employed on the one hand to provide the control variable signal u and on the other hand to provide the signal value $\hat{\epsilon}$.

After integration, this latter signal value $\hat{\epsilon}$ is employed for providing a difference signal value $\Delta\epsilon$ by comparison to the measured error angle signal value $\epsilon_m$, as shown in unit 12.

As shown in FIG. 3 the signal value of $\hat{\epsilon}$, being a prediction, is also supplied to the homing device 1 in order to ensure that said device seeks the target in a proper angular area.

The difference signal value $\Delta\epsilon$ is employed in the steering procedure of the missile to successively correct or update quantities such as state variables and parameters in the relationships of the computing unit. Thus, in FIG. 3 it is shown in a feed-back unit 13 how previously determined state variables $\hat{\dot{\theta}}$, $\hat{\alpha}$ and $\hat{\dot{\sigma}}$, a determined value of the error angle $\epsilon$ as well as the torque and force parameters $b_1$ and $b_2$ are each assigned a specific correction factor $k_1-k_6$, as shown in a block 15. Each output signal from this block 15 represents a corrector which is particular to each quantity.

The correction or updating of the respective quantities is as follows:

$$\begin{bmatrix} \hat{\dot{\theta}} \\ \hat{\alpha} \\ \hat{\dot{\sigma}} \\ \hat{\epsilon} \\ b_1 \\ b_2 \end{bmatrix}_t = \begin{bmatrix} \hat{\dot{\theta}} \\ \hat{\alpha} \\ \hat{\dot{\sigma}} \\ \hat{\epsilon} \\ \hat{b}_1 \\ \hat{b}_2 \end{bmatrix}_{t-1} + \begin{bmatrix} k_1 \\ k_2 \\ k_3 \\ k_4 \\ k_5 \\ k_6 \end{bmatrix} (\epsilon_m - \hat{\epsilon}) = \begin{bmatrix} \hat{\dot{\theta}} \\ \hat{\alpha} \\ \hat{\dot{\sigma}} \\ \hat{\epsilon} \\ \hat{b}_1 \\ \hat{b}_2 \end{bmatrix}_t + \begin{bmatrix} \Delta\hat{\dot{\theta}} \\ \Delta\hat{\alpha} \\ \Delta\hat{\dot{\sigma}} \\ \Delta\hat{\epsilon} \\ \Delta\hat{b}_1 \\ \Delta\hat{b}_2 \end{bmatrix}$$

Here index "t" denotes the corrected quantity value at the present time and index "t−1" denotes the previous quantity value. The correction factors $k_1-k_6$ are here coefficients which are dependent on the sensitivity to $\Delta\epsilon$, on the one hand, and the confidence on the other hand, of the respective quantity. Each correction factor $k_1-k_6$ is a function of the type $k_i=(f(a_1, a_2, a_3, V, r, u)$. Consequently they are variable in the steering procedure of the missile and they are calculated several times which is outlined in FIG. 3 by means of a block 14. A suitable method of calculating said correction factors $k_1-k_6$ is by means of Kalman filters; see for instance Introduction to Stochastic Control Theory, chapter 5–4, by Karl J Åström, Academic Press, New York, London, 1970.

In the unit 20 successive correction or updating of the quantity is illustrated. The correction value $\Delta\hat{\epsilon}$ is combined with a previously determined quantity value $\hat{\epsilon}_{t-1}$ in a junction point 18. A switch 19 shown between the output of said junction point and the output of the integrator 16 illustrates the introduction of the corrected quantity value $\hat{\epsilon}_t$. The updating of the other quantities is not shown in detail but takes place in a similar way.

According to a particular feature of the invention the aerodynamic parameters $a_1$–$a_3$ can be kept constant during the entire steering procedure, as is shown in FIG. 3. Thus, a required accuracy can be obtained in that only the parameters $b_1$ and $b_2$ are updated together with the quantities $\hat{\dot{\theta}}$, $\alpha$, $\hat{\dot{\sigma}}$ and $\hat{\epsilon}$.

It is realized that the signal values representing approximated quantities are predictions of said quantities at an appropriate future time.

The above discussed units for performing the invention may be implemented by means of electronic components which secure very fast computational steps.

A preferred and very compact implementation of the invention is obtained by means of a micro processor, which according to the invention, is provided to calculate $\hat{\dot{\sigma}}$. Preferably, the other functions as calculations of the control variable signal u and the signals representing both the approximate value $\hat{\epsilon}$ of the error angle and the error angle difference $\Delta\epsilon$, as well as the calculation of the correction factors $k_1$–$k_6$ and the correlation quantities, are incorporated into the micro processor which then also attends to the feed-back of the error angle difference value $\Delta\epsilon$ for updating the quantities in question. Thus, FIG. 3 includes an interface means 17 which attends to adaptation between the blocks shown therebelow in the figure and which illustrates the digitally operating micro processor, and the missile units shown thereabove in the figure and which cooperate by signal with the micro processor.

In starting the computational procedure, variables and parameters are assigned initial values determined from the momentary error angle of the missile and previously introduced information as $r_{in}$ and $V_{in}$. The calculations in the micro processor are performed in intervals between measurements of the error angle for obtaining the value $\epsilon_m$, and the signal values obtained as a result of the calculations in one computational step are memorized as predictions of a respective quantity to be employed successively in calculations in the next computational step.

The invention has been described with reference to one particular embodiment based on proportional navigation. However, the invention is not restricted to the control law of proportional navigation but any suitable control law resulting in a control signal u dependent on the line of sight angular rate $\dot{\sigma}$, viz $u=f(\dot{\sigma})$ can be envisaged. Particularly, when the missile has steering rockets instead of control surfaces a modified proportional navigations is used where guiding deflection is caused when the control signal u exceeds a predetermined value.

I claim:

1. A method for steering an aerodynamic body, e.g. a missile or a projectile, after its firing in a flight path toward a target for interception, the body having a homing device generating an output signal ($\epsilon_m$) which is a measurement of an error angle ($\epsilon$) between a body-fixed axis, preferably the symmetry axis of the body, and a line of sight ($S_i$) from the body to the target, and the body being guided in response to a control variable signal (u, $u_m$) which is dependent on the angular rate ($\dot{\sigma}$) of the line of sight, characterized in that a computing unit (10) which operates on the basis of relationships describing the aerodynamic behaviour of the body with respect to the target and has said control variable (u, $u_m$) of the body as an input signal, forms a first signal value ($\hat{\dot{\sigma}}$) representing the angular rate ($\dot{\sigma}$) of the line of sight, which is employed to provide the control variable signal (u, $u_m$), and a second signal value ($\hat{\dot{\theta}}$) representing the angular rate ($\dot{\theta}$) of the attitude of the body, that a third signal value ($\epsilon$) representing an approximate value of the error angle ($\hat{\epsilon}$) is formed from said two signal values ($\hat{\dot{\sigma}}$, $\hat{\dot{\theta}}$), that a difference signal value ($\Delta\epsilon$) between the measurement ($\epsilon_m$) and the approximate value ($\hat{\epsilon}$) of the error angle ($\epsilon$) is formed and is fed back to the computing unit for correcting quantities of the relationships of the computing unit.

2. A method as claimed in claim 1, characterized in that the difference signal value ($\Delta\epsilon$), before being fed back to the computing unit (10), is multiplied by a correction factor ($k_1-k_6$) corresponding to the respective quantity to be corrected in said relationships.

3. A method as claimed in claim 2, characterized in that the correction factor ($k_1-k_6$) is variable with respect to parameters and variables of the missile, and that the correction factor is updated in the course of the steering.

4. A method as claimed in claim 1, characterized in that the signal value ($\hat{\dot{\theta}}$) representing the attitude angular rate is determined on the basis of the equations $$\ddot{\theta}=a_1\dot{\theta}+a_2\alpha+b_1u$$

$$\dot{\alpha}=\dot{\theta}+a_3\alpha+b_2u$$

where $\theta$ is the attitude angular rate and $\ddot{\theta}$ its time differential, $\alpha$ is the aerodynamic angle of attack and $\dot{\alpha}$ its time differential, u is the control variable, $a_1$, $a_2$, $a_3$ are aerodynamic parameters, $b_1$ and $b_2$ are a torque and a force parameter, respectively, and that the signal value ($\hat{\ddot{\sigma}}$) representing the line of sight angular rate is determined on the basis of the equation $$\ddot{\sigma}=(2\dot{\sigma}+a_3\alpha+b_2u)\cdot V/r$$

and in the cases of lesser accuracy requirements $$\ddot{\sigma}=0$$

where $\dot{\sigma}$ is the line of sight angular rate and $\ddot{\sigma}$ the time differential thereof, V is the travelling speed of the body, r its distance to the target.

5. Method as claimed in claim 4, characterized in that the difference signal value ($\Delta\epsilon$) is multiplied by a correction factor ($k_1-k_6$) before being fed back to the computing unit, each factor corresponding to the respective quantity to be updated in said relationships, that said updating is performed for the torque and force parameters ($b_1$, $b_2$) while the aerodynamic parameters ($a_1$, $a_2$, $a_3$) are maintained constant.

6. An apparatus for steering an aerodynamic body, such as a missile or a projectile, after its firing towards a target for interception thereof, said body having a homing device (1) supplying an output signal ($\epsilon_m$) which is a measurement of an error angle ($\epsilon$) between a body-fixed axis (A), preferably the axis of symmetry of the body, and a line of sight ($S_i$) from the body to the target, and a unit (4) provided to determine a control variable signal (u, $u_m$) dependent upon the line of sight angular rate ($\dot{\sigma}$), characterized by a computing unit (10) which operates on the basis of relationships describing the aerodynamic behaviour of the body with respect to the target and has the control variable signal (u, $u_m$) as an input signal for establishing a first signal value ($\hat{\dot{\sigma}}$) representing the line of sight angular rate ($\dot{\sigma}$), said signal value being an input signal to the unit (4) for determining the control variable signal, and a second signal value ($\hat{\dot{\theta}}$) for the body attitude angular rate ($\dot{\theta}$), a unit (20) for determining from said two signal values a third signal value ($\hat{\epsilon}$) representing an approximate value of the error angle ($\epsilon$), a unit (12) for forming a difference signal value ($\Delta\epsilon$) between the measurement angle ($\epsilon m$) and the approximate signal value ($\hat{\epsilon}$), and a feed-back unit (13) provided to feed back to the computing unit (10) the difference signal value ($\Delta\epsilon$) of the error angle for correcting quantities of the relationships of the computing unit.

7. Apparatus as claimed in claim 6, characterized in that the feed-back unit (13) includes means (15) for modifying the error angle difference signal value ($\Delta\epsilon$) by multiplying the same by means of a factor ($k_1-k_6$) corresponding to the respective quantity to be corrected.

8. An apparatus as claimed in claim 6 or 7, characterized by a micro processor including said computing unit (10), said unit (4) for determining the control variable signal, said unit (20) for determining the third signal value ($\hat{\epsilon}$), said unit (12) for determining the difference signal value ($\Delta\epsilon$), and said feed-back unit (13).

* * * * *